United States Patent [19]

Fujiwara

[11] Patent Number: 4,589,763

[45] Date of Patent: May 20, 1986

[54] TIMING ADJUSTMENT IN A COPYING MACHINE

[75] Inventor: Katsuyoshi Fujiwara, Osaka, Japan

[73] Assignee: Sharp Kabushiki Kaisha, Osaka, Japan

[21] Appl. No.: 542,206

[22] Filed: Oct. 14, 1983

[30] Foreign Application Priority Data

Oct. 14, 1982 [JP] Japan ..... 57-181067

[51] Int. Cl.[4] ..... G03G 15/00; G03G 21/00

[52] U.S. Cl. ..... 355/14 R; 355/14 SH

[58] Field of Search ..... 355/3 R, 3 TR, 14 R, 355/14 TR, 14 SH

[56] References Cited

U.S. PATENT DOCUMENTS

| | | | |
|---|---|---|---|
| 4,214,833 | 7/1980 | Kono | 355/3 TR X |
| 4,248,527 | 2/1981 | Akiyama et al. | 355/14 R |
| 4,260,242 | 4/1981 | Nishikawa | 355/14 TR |
| 4,547,062 | 10/1985 | Fujiwara | 355/14 R |

*Primary Examiner*—Fred L. Braun

*Attorney, Agent, or Firm*—Birch, Stewart Kolasch & Birch

[57] ABSTRACT

A timing adjustment system in a copying machine includes a slit plate secured to a shaft of a photosensitive drum for developing a pulse signal of a period (t') in response to the rotation of the photosensitive drum. A copy paper supply system is enabled when a predetermined time has passed after an optical system initiates the movement. The predetermined time is determined by a pulse number (N) of the pulse signal and a time period (T) from the development of the N-th pulse signal. That is, the actual copy paper supply is conducted when $(N \cdot t' + T)$ has passed after the optical system initiated the movement. A modification preset system is provided for modifying the pulse number (N) to $(N_m)$ and the time period (T) to $(T_m)$ by taking account of the actual copying operation.

4 Claims, 7 Drawing Figures

TIMING ADJUSTMENT IN A COPYING MACHINE

BACKGROUND AND SUMMARY OF THE INVENTION

The present invention relates to a timing adjustment system in a copying machine.

Generally, there are two types of timing control systems for controlling the copy paper supply timing in a copying machine. The first type includes a slit plate secured to a shaft of a photosensitive drum. The slit plate has a plurality of slits formed at predetermined positions. Each slit provides a control signal for activating respective elements in the copying machine at desired timings. In this type of timing control system, the installation of the slit plate requires a high degree of accuracy. Moreover, the first type of control system is not applicable to a copying machine having an endless photosensitive drum.

The second type of timing control system includes a slit plate which has slits periodically formed at a predetermined interval. The second type further includes a detection switch for detecting the start point of the reciprocating optical system. A control signal is developed when a predetermined number of slits are counted after generation of a detection signal from the detection switch, the control signal being applied to a drive system for activating the elements in the copying machine. This type of conventional system can not avoid the error up to the period of the slits. If the error should be reduced, the slit interval must be reduced. This will complicate the slit detection system. Furthermore, even when the fine slit is formed, there still exists the error determined by the interval of the slits.

To minimize the timing error in the above-mentioned second type of control system, a timing adjustment system has been developed. An example is disclosed in my allowed copending application, "COPY PAPER SUPPLY TIMING CONTROL IN A COPYING MACHINE", Ser. No. 506,973 filed on June 23, 1983, now U.S. Pat. No. 4,547,062. In this adjustment system, the copy paper supply timing is controlled so that the copy paper supply is initiated when a preselected time (T) has passed after a predetermined number (N) of slits have been counted from the development of a detection signal derived from an optical system start detection sensor. The preselected time (T), which is selected shorter than a period t' of the slit output, functions to adjust the accurate timing for conducting the copy paper supply. This adjustment system further includes a control circuit for compensating the displacement of the timing in the occurence of the first slit pulse. The control circuit includes a timer for counting a time period (t) from the development of the detection signal from the optical system start detection sensor to the occurence of the first slit pulse. If the time period (t) is shorter than or equal to the preselected time (T), the copy paper supply is initiated when $(T-t)$ seconds have passed after the predetermined number (N) of slits have been counted. If the time period (t) is longer than the preselected time (T), the copy paper supply is initiated when $(T+t'-t)$ seconds have passed after the $(N-1)$ slits have been counted.

However, the above-mentioned timing adjustment system is not satisfactory because the preselected time (T) differs depending on the operating condition of the copying machine. In the above-mentioned timing adjustment system, it is difficult to modify the predetermined number (N) and the preselected time (T) by taking account of the actual operating condition of the copying machine.

Accordingly, an object of the present invention is to provide a modification system for modifying the timing control constants in a timing adjustment system of a copying machine.

Another object of the present invention is to provide a keyboard controlled modification system for modifying the preselected time (T) and the predetermined number (N) depending on the actual operating condition of the copying machine.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a mode selection switch is provided for selectively placing the copying machine in a preset mode wherein the preselected time (T) and the predetermined number (N) are preset by taking into account the actual operating condition of the copying machine.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
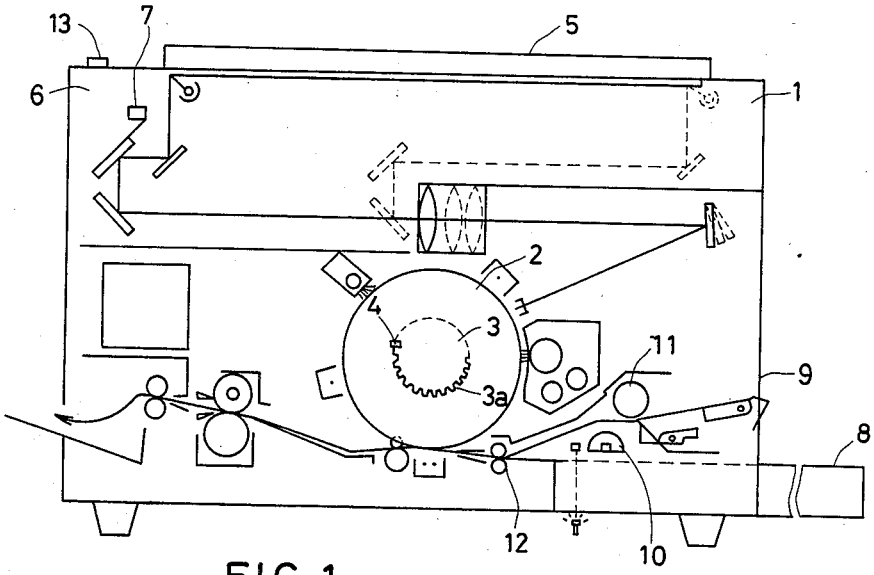
FIG. 1 is a schematic sectional view of a copying machine including an embodiment of a timing adjustment system of the present invention.

A main body 1 of a copying machine includes a photosensitive drum 2 disposed at the middle of the main body 1. A slit plate 3 is secured to the shaft of the photosensitive drum 2 so that the slit plate 3 rotates in unison with the photosensitive drum 2. The slit plate 3 has a plurality of periodical slits 3*a* which are aligned with a predetermined interval therebetween. A photo-sensor device 4 is disposed at a predetermined position in order to detect the periodical slits 3*a* formed in the slit plate 3. That is, when the slit plate 3 rotates, the photo-sensor device 4 develops a pulse signal of a period (t').

An optical system 6 is driven to reciprocate under a document table 5 for scanning the document disposed on the document table 5. The optical system 6 is normally placed in a stand-by position (shown by the solid line in FIG. 1), wherein a start point detecting switch 7 is held in an "on" state. A copy paper is supplied from either a copy paper cassette 8 or a manual inlet 9 by means of an automatic supply roller 10 or a manual supply roller 11. The thus introduced copy paper is temporarily stopped at a paper supply timing roller 12 which is normally held stationary. A copy paper supply timing control system is enabled under these conditions, namely, the copy paper is held at the paper supply timing roller 12 and the optical system 6 is held stationary at the stand-by position where the start point detecting switch 7 is in the "on" state. The photosensitive drum 2 and the slit plate 3 perform the rotating operation when the timing control system is placed in the stand-by condition.

The optical system 6 is driven to reciprocate by a motor, a drive mechanism, and a clutch mechanism. The paper supply timing roller 12 is associated with a solenoid mechanism so that the paper supply timing roller 12 rotates when the solenoid is on. A copy button 13 is provided on the keyboard panel of the main body 1 to instruct the initiation of the copying operation.

Figure 2:
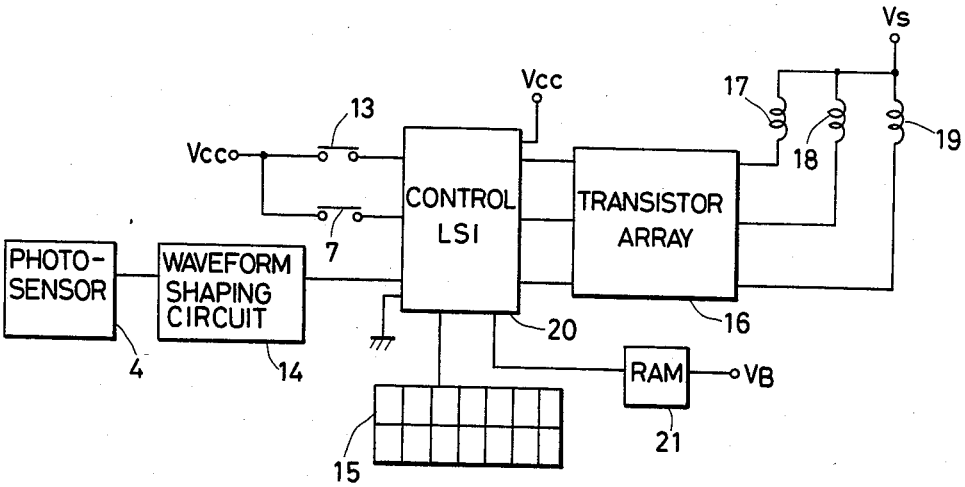
FIG. 2 is a schematic block diagram of an embodiment of a timing adjustment system of the present invention.

FIG. 2 shows the timing adjustment system of the present invention. Like elements corresponding to those of FIG. 1 are indicated by like numerals.

The timing adjustment system includes a control LSI 20 made of a one-chip microcomputer. The copy button 13, the start point detecting switch 7, and a waveform shaping circuit 14 connected to the photo-sensor device 4 are connected to input terminals of the control LSI 20. Furthermore, a key input panel 15 is connected to the control LSI 20 for introducing various commands into the control LSI 20. A transistor array chip 16 of the Darlington construction is connected to output terminals of the control LSI 20 in order to control a motor relay 17, a clutch 18, and a solenoid 19. The motor relay 17 is associated with the motor for driving the photosensitive drum 2, the optical system 6, and the copy paper supply system including the automatic supply roller 10, the manual supply roller 11, and the paper supply timing roller 12. The clutch 18 is associated with the optical system 6 so as to determine the drive timing of the optical system 6. The solenoid 19 is associated with the paper supply timing roller 12 so that the paper supply timing roller 12 is stopped when the solenoid 19 is off, and is driven to rotate when the solenoid 19 is on.

The key input panel 15 includes ten numeral keys, a clear key, a repeat key, an interruption key, etc., for introducing operation commands into the control LSI 20. The key input panel 15 further includes a mode selection switch for selectively placing the copying machine in a timing adjustment preset mode wherein a modified count pulse number $N_{nm}$ and a modified time period $T_{nm}$, suited to the copying operation of the magnification $M_n$, are written into a random access memory (RAM) included in the control LSI 20, whereby n is a positive integer, and m is zero or a positive integer. $N_{n0}$ represents a reference count pulse number for the magnification $M_n$ determined at the factory, and $T_{n0}$ represents a reference time period for the magnification $M_n$ determined at the factory. The modified count pulse number $N_{nm}$ and the modified time period $T_{nm}$ are modified values of the reference count pulse number $N_{n0}$ and the reference time period $T_{n0}$ after the modification of m times.

Figure 3:
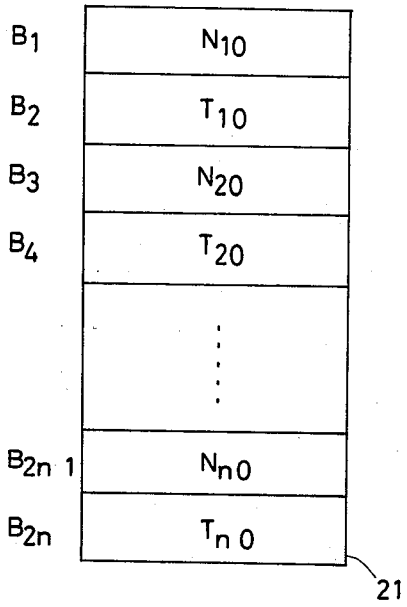
FIG. 3 is a schematic chart showing memory areas in a random access memory included in the timing adjustment system of FIG. 2.

The timing adjustment system of FIG. 2 further includes a random access memory (RAM) 21. The random access memory (RAM) 21 includes memory areas $B_1$, $B_2$, - - - , $B_{2n-1}$ and $B_{2n}$ as shown in FIG. 3. Each memory area stores zero at first. Then, each memory area stores the reference count pulse number, the reference time period, the modified count pulse number, or the modified time period. FIG. 3 shows a condition where the reference count pulse number and the reference time period are stored in the random access memory (RAM) 21. More specifically, the memory areas $B_1$ and $B_2$ store the reference count pulse number $N_{10}$ and the reference time period $T_{10}$ at the magnification $M_1$, respectively. The memory areas $B_3$ and $B_4$ store the reference count pulse number $N_{20}$ and the reference time period $T_{20}$ at the magnification $M_2$, respectively. Similarly, the memory areas $B_{2n-1}$ and $B_{2n}$ store the reference count pulse number $N_{n0}$ and the reference time period $T_{n0}$ at the magnification $M_n$, respectively.

The read-out operation is conducted in accordance with a selected magnification $M_i$. More specifically, when the magnification $M_i$ is selected, the memory areas $B_{2i-1}$ and $B_{2i}$ are selected to read out the reference or modified count pulse number $N_{ik}$ and the reference or modified time period $T_{ik}$. The presetting operation for modifying the reference count pulse number and the reference time period to the modified count pulse number and the modified time period is conducted through the use of the key input panel 15. The modification is conducted by introducing a numeral data of two digits. The upper digit represents the count pulse number $N_{ik}$ and the lower digit represents the time period $T_{ik}$. The thus introduced modification data is temporarily stored in the memory areas $A_1$ and $A_2$ of a random access memory (RAM) included in the control LSI 20 (see FIG. 4). Then, the modification data is transferred to the memory areas $B_{2i-1}$ and $B_{2i}$ of the random access memory (RAM) 21 with reference to the magnification $M_i$. The random access memory (RAM) included in the control LSI 20 and the random access memory (RAM) 21 are connected to the back-up battery to maintain the data stored therein even when the main power switch is turned off.

Figure 4:
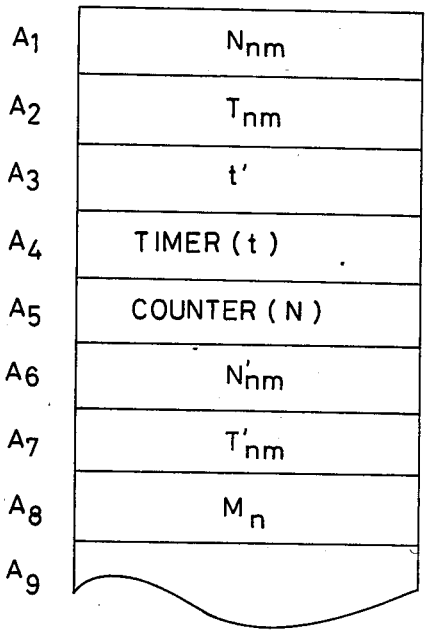
FIG. 4 is a schematic chart showing memory areas in a memory included in a control LSI within the timing adjustment system of FIG. 2.

FIG. 4 shows the memory areas of the random access memory (RAM) included in the control LSI 20. The memory area $A_1$ stores the count pulse number $N_{nm}$ of slit pulses which should be counted from the initiation of the travel of the optical system 6 to the initiation of the rotation of the paper supply timing roller 12. The memory area $A_2$ stores the time period $T_{nm}$ which should be passed before initiating the rotation of the paper supply timing roller 12 after the slit pulses have been counted by the count pulse number $N_{nm}$. The memory area $A_3$ stores a period t' of the slit pulses derived from the waveform shaping circuit 14. That is, the system is constructed to initiate the rotation of the paper supply timing roller 12 when a period of time $(N_{nm} \cdot t' + T_{nm})$ has passed after the start point detecting switch 7 detects the start of the optical system 6. The memory area $A_4$ functions as a timer for counting a time period t commencing at the turning off of the start point detecting switch 7 and ending at the development of the first slit pulse. The memory area $A_5$ functions as a counter for counting slit pulses after the start point detecting switch 7 is switched off. The random access memory included in the control LSI 20 further includes memory areas $A_6$ and $A_7$ for temporarily storing a desired pulse number $N'_{nm}$ and a desired time period $T'_{nm}$, respectively, which are calculated through the use of the counted time period t stored in the memory area $A_4$, the count pulse number $N_{nm}$ stored in the memory area $A_1$, and the time period $T_{nm}$ stored in the memory area $A_2$. The thus obtained desired pulse number $N'_{nm}$ and the desired time period $T'_{nm}$ are used to control the copy paper supply timing in the actual copying operation of the magnification $M_n$. The memory area $A_8$ stores the selected magnification $M_n$.

Figure 5:
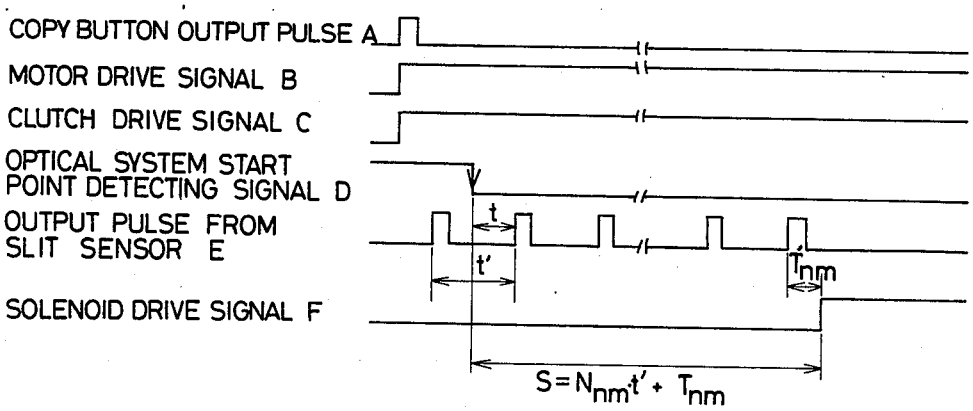
FIG. 5 is a time chart for explaining an operational mode of the timing adjustment system of FIG. 2.

More specifically, when the copy button 13 is actuated, a copy button output pulse A is developed as shown in the time chart of FIG. 5. In response to the copy button output pulse A, a motor drive signal B and a clutch drive signal C are developed to rotate the photosensitive drum 2 and the automatic supply roller 10.

The slit pulse is periodically developed with a period t' in response to the rotation of the slit plate 3, and the copy paper is supplied to the paper supply timing roller 12 and is held stationary at the paper supply timing roller 12. When a certain time has passed, the optical system 6 moves forward to turn off the start point detecting switch 7, whereby an optical system start point detecting signal D bears the logic low. In response to the trailing edge of the optical system start point detecting signal D, the timer (memory area $A_4$) initiates the counting operation. A reference clock signal of the control LSI 20 is used to count the time period t which represents a time period from the initiation of the movement of the optical system 6 to the development of the first slit pulse.

When the counted time period t is shorter than or equal to the stored time period $T_{nm}$ memorized in the memory area $A_2$, the control LSI 20 functions to introduce into the memory area $A_6$ the number $N'_{nm}$ identical to the pulse number $N_{nm}$ stored in the memory area $A_1$, and to introduce into the memory area $A_7$ the desired time period $T'_{nm}$ which is $(T_{nm}-t)$. That is, in this case the control time period $(N_{nm}\cdot t'+T_{nm})$ is counted in a manner, $(t+N_{nm\cdot t'}+(T_{nm}-t))$. Contrarily, when the counted time period t is longer than the time period $T_{nm}$ stored in the memory area $A_2$, the control LSI 20 functions to introduce the desired number $N'_{nm}$, which is $(N_{nm}-1)$, into the memory area $A_6$, and to introduce the desired time period $T'_{nm}$, which is $(T_{nm}+t'-t)$, into the memory area $A_7$. That is, in this case the control time period $(N_{nm}\cdot t'+T_{nm})$ is counted in a manner, $(t+(N_{nm}-1)\cdot t'+(T_{nm}+t'-t))$. The thus obtained desired pulse number $N'_{nm}$ and the desired time period $T'_{nm}$ are used to control the copy paper supply timing in the copying machine. More specifically, when the actual counting operation of the slit pulses and the time period after the last slit pulse reaches the desired pulse number $N'_{nm}$ stored in the memory area $A_6$ and the desired time period $T'_{nm}$ stored in the memory area $A_7$, respectively, a solenoid drive signal F is developed as shown in FIG. 5 to activate the solenoid 19. The paper supply timing roller 12 starts the rotation operation to transfer the copy paper toward a transcription section. Accordingly, the copy paper supply timing is accurately controlled without regard to the generation timing of the trailing edge of the optical system start point detecting signal D.

An operational mode of the timing adjustment system of the present invention will be described with reference to FIGS. 6(A) and 6(B).

Figure 6A:
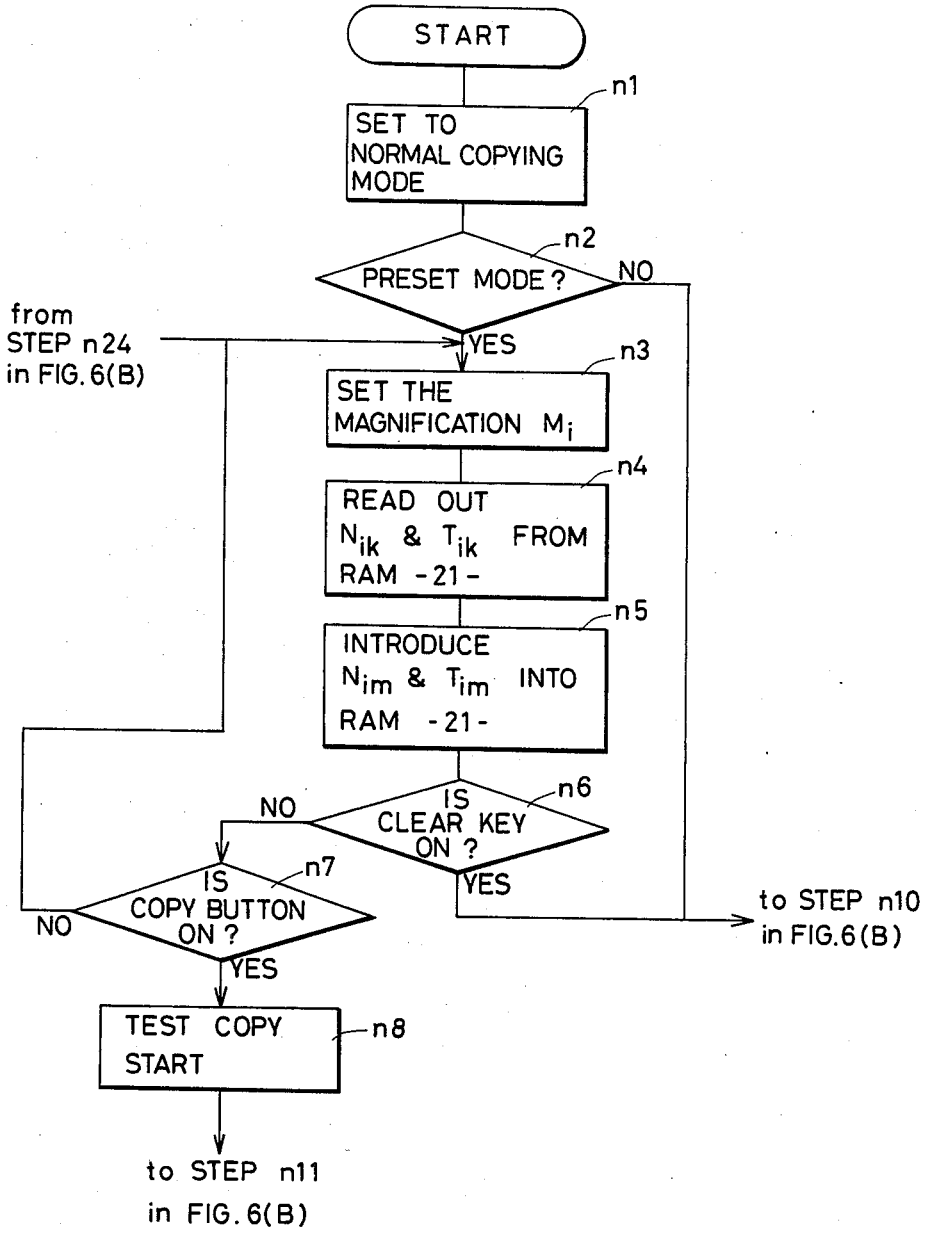
FIGS. 6(A) and 6(B) are flow charts for explaining an operational mode of the timing adjustment system of FIG. 2.
Figure 6:
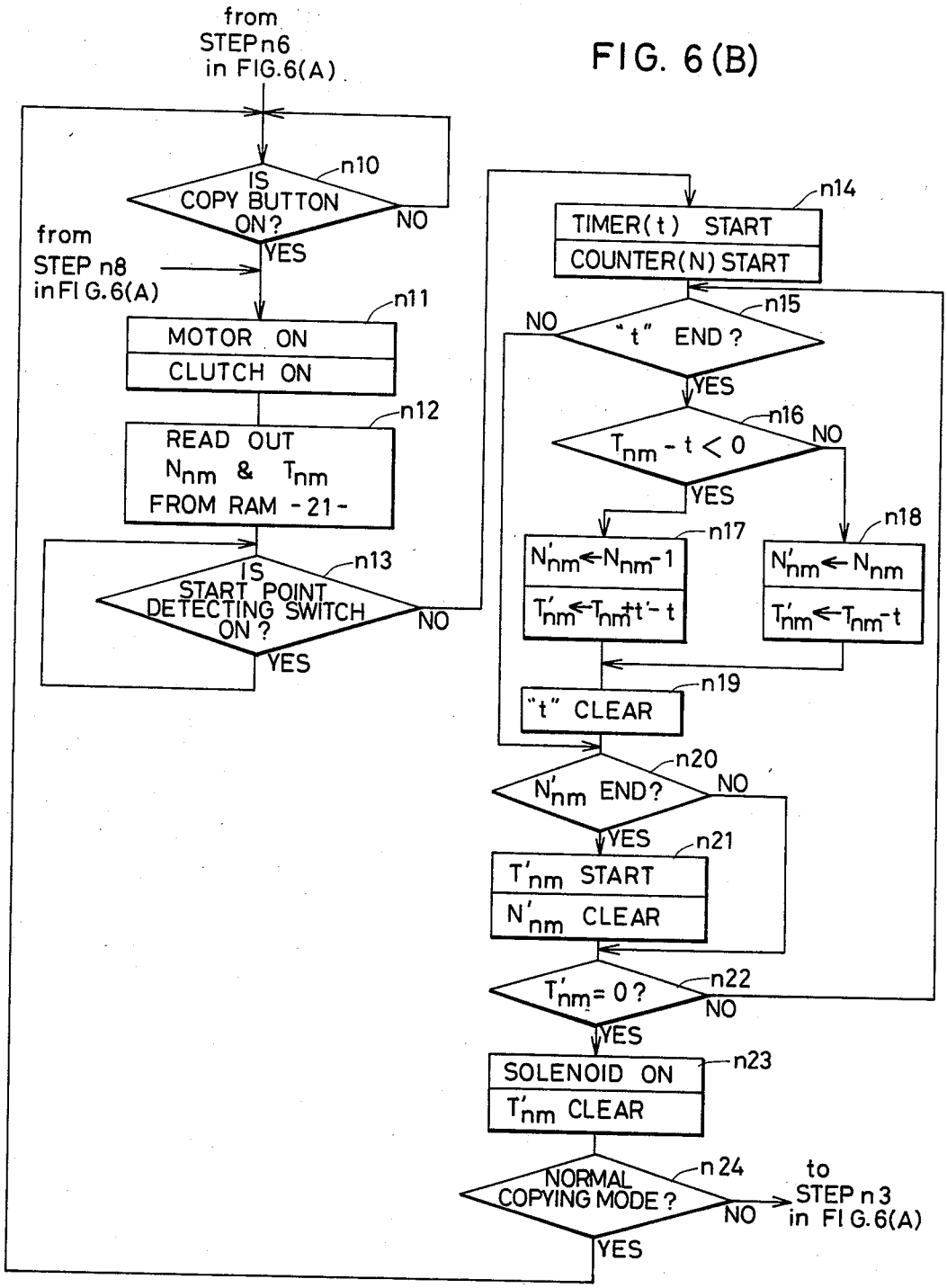

The operational flow shown in FIGS. 6(A) and 6(B) is controlled by a program stored in a read only memory (ROM) included in the control LSI 20. When the main power supply switch is switched on, the copying machine is placed in the normal copying operation mode at the step n1. When the mode selection switch is operated to place the copying machine in the preset mode, the operation is advanced from the step n2 to the step n3 where the magnification $M_i$ is set and the selected magnification $M_i$ is displayed on a display panel. At the following step n4, the count pulse number $N_{im}$ and the time period $T_{im}$ corresponding to the magnification $M_i$ are read out from the random access memory (RAM) 21. As already discussed above, at the initial state, the count pulse number $N_{im}$ and the time period $T_{im}$ are zero. The reference count pulse number $N_{i0}$ and the reference time period $T_{i0}$ corresponding to the magnification $M_i$ are written into the memory areas $B_{2i-1}$ and $B_{2i}$ of the random access memory 21, respectively, through the use of the key input panel 15. That is, the numeral data of two digits is introduced from the numeral keys included in the key input panel 15. The upper digit numeral is introduced into the memory area $B_{2i-1}$ and the lower digit numeral is introduced into and stored in the memory area $B_{2i}$ of the random access memory 21. When the clear key actuation is detected at step n6, the preset mode is released and the copying machine is placed in the normal copying operation mode.

When the copy button 13 is actuated without actuating the clear key, the operation is advanced from step n7 to step n8. That is, the copying operation is carried out even though the copying machine is placed in the preset mode. In this case, the copying operation is conducted in accordance with the reference count pulse number $N_{i0}$ and the reference time period $T_{i0}$ stored in the memory areas $B_{2i-1}$ and $B_{2i}$ of the random access memory 21. The copying operation will be described later with reference to the steps n11 through n23. The operator checks whether the timing is properly adjusted by observing the copied paper. If the timing is accurately adjusted, the clear key is actuated to place the copying machine in the normal copying operation mode. When displacement of the copied image is observed, the modified count pulse number $N_{i1}$ and the modified time period $T_{i1}$ is written into the random access memory 21 at step n5. Under these conditions, when the copy button 13 is actuated without actuating the clear key, the copying operation is again conducted in the preset mode. In this case, the copying operation is carried out in accordance with the modified count pulse number $N_{i1}$ and the modified time period $T_{i1}$. If an accurate timing adjustment is observed, the clear key is actuated to place the copying machine in the normal copying operation mode. In this way, the memory areas $B_{2i-1}$ and $B_{2i}$ store the modified count pulse number $N_{i1}$ and the modified time period $T_{i1}$, respectively. When an accurate timing adjustment is not observed, another modified count pulse number $N_{i2}$ and time period $T_{i2}$ are written into the memory areas $B_{2i-1}$ and $B_{2i}$ at step n5. These operations are repeated until an accurate timing adjustment is achieved. The preset operation is conducted for the magnification $M_1$ to the magnification $M_n$. When the presetting operation is completed, the clear key is actuated to place the copying machine in the normal copying operation mode.

The normal copying operation is conducted in the following manner when the magnification $M_n$ is selected and the modified count pulse number $N_{nm}$ and the modified time period $T_{nm}$ are stored in the memory areas $B_{2n-1}$ and $B_{2n}$ of the random access memory 21, respectively.

When the actuation of the copy button 13 is detected at step n10, the motor relay 17 is enabled at step n11 to initiate the rotation of the photosensitive drum 2 and the automatic supply roller 10. At the following step n12, the modified count pulse number $N_{nm}$ and the modified time period $T_{nm}$ stored in the random access memory 21 are read out and written into the random access memory (RAM) included in the control LSI 20. When the starting of the optical system 6 is detected at step n13 (the optical system start point detecting signal D changes to the logic low), the operation is advanced to step n14 to start the counting operation of the timer t (memory area $A_4$) and the counter N (memory area $A_5$. Before the slit pulse is detected, the operation is skipped from step n15 to step n20 and returned to step n15. When the slit pulse is detected at step n15, the time counting operation of the time period t is terminated and the obtained time period t is stored in the memory area $A_4$. At the following step n16, the obtained time period t stored in the memory area $A_4$ is compared with the preset modified time period $T_{nm}$ stored in the memory area $A_2$. If the obtained time period t is longer than the preset modified time period $T_{nm}$, the operation is advanced to step n17, where the desired pulse number $N'_{nm}$ $(=N_{nm}-1)$ is introduced into the memory area $A_6$, and the desired time period $T'_{nm}$ $(=T_{nm}+t'-t)$ is introduced into the memory area $A_7$. Contrarily, if the time period t is shorter than or equal to the preset modified time period $T_{nm}$, the operation is advanced to step n18, where the desired pulse number $N'_{nm}$ $(=N_{nm})$ is introduced into the memory area $A_6$ and the desired time period $T'_{nm}$ $(=T_{nm}-t)$ is introduced into the memory area $A_7$. At the following step n19, the timer t (memory area $A_4$) is cleared, and the slit pulse counting operation is conducted at the step n20. When the slit pulse has been counted by the desired number $N'_{nm}$, the operation is advanced from step n20 to step n21 to initiate the down counting operation of the desired time period $T'_{nm}$. That is, the reference clock signal of the control LSI 20 is applied to the memory area $A_7$ to count down the period $T'_{nm}$ stored therein. When the count contents stored in the memory area $A_7$ reach zero, that is, when the time period $T'_{nm}$ has passed after the last slit pulse, the operation is advanced from step n22 to step n23. The solenoid 19 is energized to initiate the rotation of the paper supply timing roller 12, whereby the copy paper is advanced to the transcription section. In the normal copying operation mode, the operation is returned from step n24 to step n10.

An example of the operation is as follows. Now assume that the magnification $M_n=1$, the reference count pulse number $N_{n0}=5$, the reference time period $T_{n0}=0$, the pulse period $t'=20$ msec., the copy paper transferring speed is 0.25 mm/msec., and the modification of the time period $T_{n0}$ is carried out through the use of ten numbers 0 through 9 (one unit represents 2 msec.). First, the reference count pulse number $N_{n0}$ and the reference time period $T_{n0}$ are written into the memory areas $B_{2n-1}$ and $B_{2n}$ of the random access memory (RAM) 21 by introducing the numeral data of "50" from the key input panel 15. The test copy is conducted under the preset mode. If the copy paper transfer is delayed by 0.5 mm with respect to the developed image, the modification data "49" is introduced from the key input panel 15 to set the modified count pulse number $N_{n1}$ to "4" and the modified time period $T_{n1}$ to "9 (18 msec.)". If the copy paper transfer timing is earlier than the desired timing by 0.5 mm, the modification data "51" is introduced from the key input panel 15 to set the modified count pulse number $N_{n1}$ to "5" and the modified time period $T_{n1}$ to "1 (2 msec.)".

The invention being thus described, it will be obvious that the same may be varied in many ways. Such variations are not to be regarded as a departure from the spirit and scope of the invention, and all such modifications are intended to be included within the scope of the following claims.

What is claimed is:

1. A timing adjustment system for a copying machine comprising:

a slit plate secured to a shaft of a photosensitive drum of the machine, said slit plate having a plurality of slits formed with a predetermined distance therebetween;

detection means for detecting said slits formed in said slit plate and for developing slit detection pulses of a period (t') when said slit plate rotates;

optical system start detecting means for developing an optical system start signal when an optical system of the machine starts its movement;

memory means for memorizing a desired delay time from the development of said optical system start signal to a supply timing of a copy paper, said memory means including:

a first memory section for memorizing a pulse number ($N_0$) of the slit detection pulses;

a second memory section for memorizing a time period ($T_0$) from the development of the $N_0$-th slit detection pulse to the supply timing of the copy paper;

mode selection means for selectively placing the copying machine in a preset mode;

input means for modifying said pulse number ($N_0$) to a modified pulse number ($N_1$) and for modifying said time period ($T_0$) to a modified time period ($T_1$), in said preset mode to take into account actual operating conditions of said copy machine; and control means, responsive to said input means, for developing a control signal and for performing the copy paper supply when said desired delay time, equalling $N_1 \cdot t' + T_1$, has passed after the development of said optical system start signal.

2. The timing adjustment system according to claim 1, wherein said memory means includes a random access memory (RAM) having at least two memory sections assigned to each of said first memory section and said second memory section.

3. The timing adjustment system according to claim 1, wherein said input means is a key input panel for introducing operation commands into said control means.

4. The timing adjustment system of claim 1, wherein said control means includes timer means for counting a time period (t) from the development of said optical system start signal to the detection of a first said slit detection pulse.

* * * * *